US006508573B1

(12) United States Patent
Yamazaki

(10) Patent No.: US 6,508,573 B1
(45) Date of Patent: Jan. 21, 2003

(54) INCANDESCENT LAMP

(75) Inventor: Kengo Yamazaki, Kakogawa (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 3 days.

(21) Appl. No.: 09/670,263

(22) Filed: Sep. 27, 2000

(30) Foreign Application Priority Data

Oct. 6, 1999 (JP) ..... 11-285134

(51) Int. Cl.[7] ..... F21V 9/08; H01K 1/26

(52) U.S. Cl. ..... 362/255; 362/293; 313/112; 313/580

(58) Field of Search ..... 362/255, 256, 362/293, 510; 313/112, 479, 315, 316, 580

(56) References Cited

U.S. PATENT DOCUMENTS 4,109,175 A * 8/1978 Watarai et al. ..... 313/112
4,395,653 A * 7/1983 Graff ..... 313/112
4,441,046 A * 4/1984 James ..... 313/112
4,633,127 A * 12/1986 Beurskens et al. ..... 313/112

FOREIGN PATENT DOCUMENTS

JP 9-330685 12/1997

* cited by examiner

*Primary Examiner*—Alan Cariaso
(74) *Attorney, Agent, or Firm*—Nixon Peabody LLP; David S. Safran

(57) ABSTRACT

To provide an incandescent lamp having a film with high color-temperature conversion capable of raising the color temperature of light radiated from an incandescent lamp in which the strength of the film with high color-temperature conversion in question is raised to prevent cracking and peeling, and to provide said lamp through a simple method of production, the film with high color-temperature conversion contains red optical-absorbent fine particles dispersed in a binder formed on the surface of a glass bulb. The red optical-absorbent fine particles have a mean particle diameter of 1 nm to 1000 nm and form 50 to 90 wt % of the film. Furthermore, the binder in the film with high color-temperature conversion also has red optical-absorption properties.

4 Claims, 1 Drawing Sheet

INCANDESCENT LAMP

BACKGROUND OF THE INVENTION

1. Field of the Invention

The present invention is directed to an incandescent lamp ideally used as a light source of headlights in automobiles, for example.

2. Description of Related Art

Incandescent lamps in conventional automobile headlights have had a film with a high color-temperature conversion comprising a composite oxide of silicon and cobalt or a composite oxide of silicon, cobalt and phosphorous formed on the surface of a glass bulb, as presented in the gazette of Japanese Kokai Publication Hei-9-330685, for example. Such films with high color-temperature conversion absorb the red optical constituents contained at a high level in the light radiated from filament coils, thereby raising the color temperature of the light which is transmitted. They are formed by dipping in a coating liquid of mixed liquids in which the material of the film with high color-temperature conversion is dissolved, followed by drying and baking.

However, the thermal-shock resistance to temperature changes accompanying turning on and off of the lamp is low because the strength of such a film with high color-temperature conversion is low and the resistance to ambient moisture deteriorates at high temperature/humidity. Consequently, such lamps suffer extreme deterioration in long-term use and readily suffer peeling or cracking in a short period of time.

In addition, the thickness of a coating film that is formed in a single dipping operation is low in forming the film with high color-temperature conversion in question. Numerous dipping operations followed by drying/baking operations are required to form a film with high color-temperature conversion having the requisite film thickness. Consequently, the completion of an incandescent lamp that radiates 4000 K of color temperature light that is ideal as an automobile lamp is difficult. Moreover, stress accumulates in films with high color-temperature conversion that are formed by numerous film formation processes because of an increase in the number of layers. That leads to peeling of the layers, and the film with high color-temperature conversion is prone to contamination.

SUMMARY OF THE INVENTION

The present invention was completed in light of aforementioned circumstances. The purpose is to provide an incandescent lamp having a film with high color-temperature conversion capable of raising the color temperature of light radiated from an incandescent lamp, thereby increasing the strength of the film with high color-temperature conversion in question in order to prevent cracking or peeling in a simple production method.

The incandescent lamp pursuant to the present invention is formed of a film with high color-temperature conversion containing red optical-absorbent fine particles dispersed in a binder on the surface of a glass bulb. The mean particle diameter of the red optical-absorbent fine particles contained in the film aforementioned high color-temperature conversion is 1 nm to 1000 nm.

In addition, the content proportion of red optical-absorbent fine particles in the film with high color-temperature conversion is 50 to 90 wt %. Furthermore, the binder in the film with high color-temperature conversion should, itself, have red optical-absorption characteristics.

Part of the red optical component of the light from the filament coil transmitted through the film with high color-temperature conversion in question is absorbed due to the action of the red optical-absorbent fine particles dispersed in the binder forming the film with high color-temperature conversion that is formed on the surface of a glass bulb in the incandescent lamp having aforementioned structure. That raises the color temperature resulting in the external radiation of high-purity white light. In addition, the strength of the film with high color-temperature conversion in question is increased because the red optical-absorbent fine particles act as an aggregate in the film with high color-temperature conversion. That results in great durability and permits long-term use.

BRIEF DESCRIPTION OF DRAWINGS

The sole FIGURE is a sectional view showing one example of the structure of an incandescent lamp having a film with high color-temperature conversion formed on the surface pursuant to the present invention.

DETAILED DESCRIPTION OF THE PREFERRED EMBODIMENT

Figure 1:
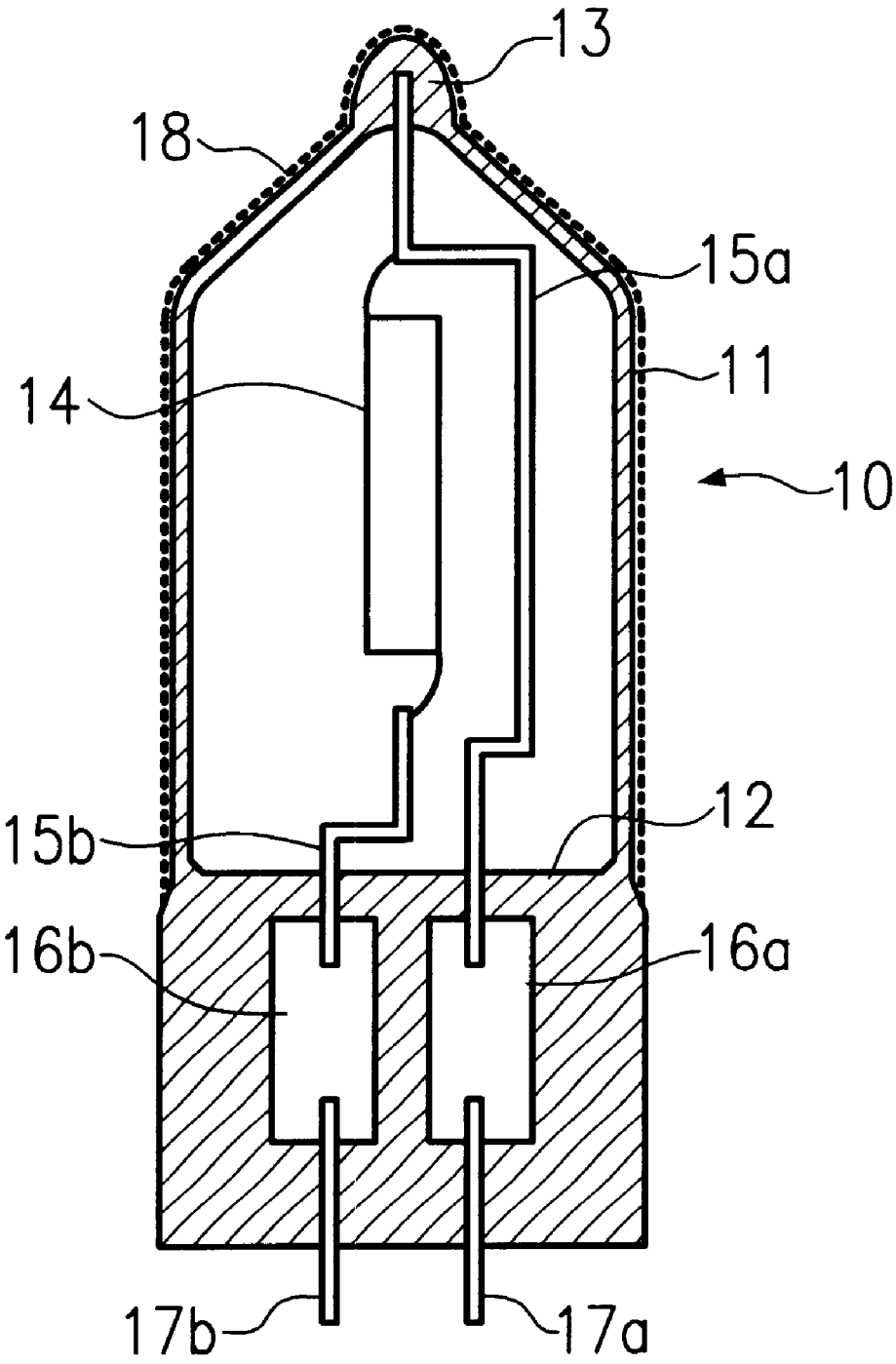

FIG. 1 shows one example of an incandescent lamp 10 produced pursuant to the present invention. This incandescent lamp 10 is for general illumination. It is provided with a quartz bulb 11 having sealing section 12 at one end and duct remnant 13 at the other end. Luminous filament coil 14 is disposed within bulb 11 so as to extend along the axis of bulb 11. In addition, inert gas containing nitrogen gas, for example, and halogen compounds are sealed within the bulb 11.

An internal lead line 15*a* is connected to one end of filament coil 14 while another internal lead line 15*b* is connected to the other end. Each of the tips of this pair of internal lead lines 15*a* and 15*b* extends to sealing section 12, is embedded within sealing section 12 at a mutual separation and is connected to metal foils 16*a* and 16*b*, respectively. The other end of internal lead line 15*a* is inserted held within duct remnant 13 of bulb 11. Furthermore, external lead lines 17*a* and 17*b*, that extend outward from sealing section 12, are connected to each of metal foils 16*a* and 16*b*.

A film with high color-temperature conversion 18 is formed on the surface of bulb 11. Film with high color-temperature conversion 18 contains red optical-absorbent fine particles dispersed within a binder. The red optical-absorbent fine particles are powder particles having a mean particle diameter of 1 nm to 1000 nm and comprise a material that absorbs at least part of the red optical component on the long wavelength side of visible light due to the characteristics of the constituents. So-called ultra-fine particles having a mean particle diameter of 5 to 300 nm would be preferable.

Concrete examples of red optical-absorbent fine particles are composite oxides containing metal elements having red optical-absorption characteristics, such as silicon and cobalt; aluminum and cobalt; aluminum, cobalt and chromium, silica and neodymium, etc. The use of composite oxides containing cobalt would be especially desirable.

The production of the red optical-absorbent fine particles in question as well as their uniform dispersion in binder would be difficult if the mean particle diameter of the red optical-absorbent fine particles is under 5 nm, while the film with high color-temperature conversion becomes turbid due to photodispersion of the transmitted light by the red optical-absorbent fine particles if it exceeds 300 nm.

The red optical-absorbent fine particles are present in a state of dispersion within the binder of the film. The binder discussed here is a constituent that binds the red optical-absorbent fine particles to form a film that is adhered to the surface of bulb 11, the core. There is no limitation on the properties of the binder, but various types of metal oxides or composite oxides, such as silicon, titanium, aluminum and the like would be preferable. The binder itself has red optical-absorption characteristics since it comprises composite oxides containing cobalt metal, for example.

The content proportion of red optical-absorbent fine particles in the film with high color-temperature conversion formed from the binder and red optical-absorbent fine particles is 50 to 90 wt %, preferably 60 to 80 wt %. There is the danger that sufficient strength would not be attained in the resulting film with high color-temperature conversion if the content proportion of red optical-absorbent fine particles should exceed 90 wt % because the proportion of binder would inevitably become too low. On the other hand, the red optical-absorption by the red optical-absorbent fine particles in question would become inadequate should the content proportion of red optical-absorbent fine particles fall below 50 wt %, and the color temperature of the radiated light from the resulting incandescent lamp would not become high enough.

When the incandescent lamp having aforementioned structure is lit, the light radiated from filament coil 14 is transmitted through the film with high color-temperature conversion 18 that is formed on the surface of bulb 11, at which time part of the red optical constituent is absorbed by the red optical-absorbent fine particles in the film with high color-temperature conversion 18. As a result, white light having a purity higher than the color temperature is radiated on the surface.

The film with high color-temperature conversion 18 contains red optical-absorbent fine particles dispersed within a binder. The strength of the film itself is great since the red optical-absorbent fine particles function as an aggregate. Accordingly, the thermal-shock resistance to temperature changes accompanying the lamp being turned on and off is high, and cracking as well as peeling are suppressed. Moreover, the moisture resistance as well as the durability are outstanding, and the film with high color-temperature conversion in question is able to adequately withstand high temperatures during illumination since it has outstanding heat resistance brought about by the fact that the constituent red optical-absorbent fine particles and binder are both inorganic substances, such as oxides.

The requisite action of the film with high color-temperature conversion is attained by a slight amount of red optical-absorbent fine particles if the binder itself has red optical-absorption characteristics.

The film with high color-temperature conversion 18 forms a coating through the application of a coating liquid discussed below on the surface of bulb 11 of an incandescent lamp followed by drying. This coating can be formed through the process of formation of a baked coating layer. If a film with high color-temperature conversion having the target characteristics cannot be formed through the process of forming a single coating layer, the process in question would be repeated. There is no specific limitation on the method of applying this coating liquid, but the dip application method would be ideally utilized.

The coating liquid used to obtain the film with high color-temperature conversion is a fluid comprising a solution of binder constituents dissolved in a suitable liquid solvent in which the red optical-absorbent fine particles discussed below are dispersed.

The use of an organic solvent that vanishes upon baking would be preferable as the liquid solvent, and a coating liquid having ideal viscosity could be prepared by adjusting the proportions. There is no specific limitation on such liquid media, but alcohols including methanol, ethanol, propyl alcohol, isopropyl alcohol, etc., could be used preferably.

Furthermore, the film thickness of the coating film that is formed in a single dipping operation can be increased since the coating liquid contains red optical-absorbent fine particles. Consequently, film with high color-temperature conversion of requisite thickness can be formed through at least numerous coat-layer-formation processes. Thus, an incandescent lamp having the target film with high color-temperature conversion can be easily produced.

The incandescent lamp having aforementioned structure would be ideal for those applications in which white light having high color temperature is required. It would be especially desirable in automobile headlights and in various illumination devices.

The present invention is not restricted to aforementioned mode of implementation. Various modifications of it are permissible.

For example, the color temperature of white light radiated externally can be regulated by controlling the film thickness of the film with high color-temperature conversion and the content proportion of the red optical-absorbent fine particles.

Furthermore, the concrete structure of incandescent lamps excluding the film with high color-temperature conversion is not restricted to the lamp shown in the diagram. Suitable examples may be used.

EXAMPLES

An example of the present invention is explained below, but the present invention is not restricted to this example.

Working Example

A coating liquid was prepared by mixing 75 weight parts of an ethanol dispersion containing 10 wt % of red optical-absorbent fine particles comprising composite oxide ($SiO_2$—CoO) containing silicon and cobalt metal elements with mean particle diameter of 20 nm and 25 weight parts of an ethanol solution containing a 15 wt % concentration of silicon alkoxide. The proportion of red optical-absorbent fine particles to binder in this coating liquid was about 66.7:33.3.

A 55 W automobile single-edge sealed halogen incandescent bulb furnished with a bulb of quartz glass was prepared. A film with high color-temperature conversion was formed by the process of coat-layer formation comprising dipping in a coating liquid followed by drying/baking. The dipping operation was carried out at a raising speed of 6.5 mm/s, and baking was carried out for four minutes at a temperature of 550° C. following dipping.

An incandescent lamp that radiates light ideally having about 4000 K color temperature was thereby obtained as an incandescent lamp for an automobile headlight.

Effects of Invention

Through the action of red optical-absorbent fine particles that are dispersed in a binder of film with high color-temperature conversion formed on the surface of a glass bulb, part of the red light of the light issued from a filament coil transmitted through the film with high color-temperature conversion in question is absorbed, thereby raising the color temperature. As a result, high-purity white light is radiated externally and the strength of the film with high color-temperature conversion in question is raised since the red optical-absorbent fine particles function as the aggregate in the film with high color-temperature conversion. That enables the durability to be raised and permits long-term use.

In addition, the incandescent lamp pursuant to the present invention can be produced by an extremely simple method of preparing coating liquid containing red optical-absorbent fine particles and applying it.

What is claimed is:

1. An incandescent lamp having a glass bulb and a film with high color-temperature conversion containing red optical-absorbent fine particles dispersed in a binder formed on a surface of the glass bulb, wherein the red optical absorbent fine particles have a mean particle diameter of 1 to 1000 nm.

2. The incandescent lamp of claim 1, in which the content of red optical-absorbent fine particles in the film with high color-temperature conversion is 50 to 90 wt %.

3. The incandescent lamp of claim 2, in which the binder in the film also has red optical-absorption characteristics.

4. The incandescent lamp of claim 1, in which the binder in the film also has red optical-absorption characteristics.

* * * * *